United States Patent [19]

Nakano et al.

[11] 4,037,004

[45] July 19, 1977

[54] METHOD FOR PRODUCING THERMOPLASTIC RESIN FILMS OR SHEETS FOR CHELATE COLOR PRINTING

[75] Inventors: Shiro Nakano, Suita; Norio Kanbe, Amagasaki; Tsugumichi Nakagawa, Hirakata; Akira Nishio, Takatsuki; Kengo Kitahara, Funabashi, all of Japan

[73] Assignees: Sekisui Kagaku Kogyo Kabushiki Kaisha; Tomoegawa Paper Co., Ltd., both of Japan

[21] Appl. No.: 511,727

[22] Filed: Oct. 3, 1974

Related U.S. Application Data

[62] Division of Ser. No. 413,509, Nov. 7, 1973, abandoned.

[30] Foreign Application Priority Data

| | | |
|---|---|---|
| Nov. 9, 1972 | Japan | 47-112729 |
| Nov. 9, 1972 | Japan | 47-112730 |
| Nov. 9, 1972 | Japan | 47-112731 |
| Nov. 9, 1972 | Japan | 47-112732 |

[51] Int. Cl.[2] ..... B41M 5/12; B05D 5/04

[52] U.S. Cl. ..... 427/145; 427/246; 427/307; 428/320

[58] Field of Search ..... 117/1.7, 10, 11; 427/245, 246, 145, 373, 307, 150, 151; 428/199, 304, 305, 539, 320, 904; 8/29, 31, 52; 260/429

[56] References Cited

U.S. PATENT DOCUMENTS

| | | | |
|---|---|---|---|
| 2,148,405 | 2/1939 | Mitchell | 428/320 X |
| 2,757,100 | 7/1956 | Simril | 117/138.8 UA X |
| 2,971,858 | 2/1961 | Giulio et al. | 117/7 X |
| 3,135,622 | 6/1964 | Ranalli | 117/15 X |
| 3,186,859 | 6/1965 | Surowitz | 117/1.7 |
| 3,408,218 | 10/1968 | Van Muylwijk | 117/15 |
| 3,515,567 | 6/1970 | Tani et al. | 117/11 |
| 3,598,642 | 8/1971 | Huang et al. | 117/138.8 UA |
| 3,704,154 | 11/1972 | Tatsuta et al. | 117/11 X |
| 3,729,332 | 4/1973 | Grubb et al. | 117/11 |
| 3,850,667 | 11/1974 | Tani et al. | 117/47 A X |
| 3,870,435 | 3/1975 | Watanabe et al. | 427/261 |
| 3,896,255 | 7/1975 | Kato et al. | 427/145 X |
| 3,919,450 | 11/1975 | Shimizu et al. | 427/151 X |

OTHER PUBLICATIONS

*Handbook of Chemistry and Physics,* 47th Edition, 1966–1967, Cleveland, Ohio, The Chemical Rubber Co., pp. C–311 and C–438.

Martell and Calvin, *Chemistry of the Metal Chelate Compounds,* pp. 182 and 183 (lines 4–6), New Jersey, Prentice Hall, Inc., 1956.

*Primary Examiner*—Ronald H. Smith
*Assistant Examiner*—Evan K. Lawrence
*Attorney, Agent, or Firm*—Wenderoth, Lind & Ponack

[57] ABSTRACT

Method for producing a thermoplastic resin film or sheet useful for chelate color printing which involves contacting at least one surface of a thermoplastic resin film or sheet with a mixed liquid composition comrising (i) a liquid capable of dissolving or swelling said thermoplastic resin, (ii) a liquid having no ability to dissolve or swell said thermoplastic resin, being compatible with said liquid (i) and having a faster rate of evaporation than said liquid (i), and (iii) an inorganic compound containing at least one metal atom selected from the group consisting of iron, vanadium, titanium, molybdenum and tungsten, or an organic compound capable of forming a chelate compound with the metal atom and developing a color, and evaporating off said liquids (i) and (ii), thereby to form a porous surface layer of the film or sheet to which is adhered an uppermost chelate color printing layer comprising said inorganic or organic compound (iii). The mixed liquid composition may also contain an insoluble finely divided substance and a cellulose derivative.

20 Claims, No Drawings

METHOD FOR PRODUCING THERMOPLASTIC RESIN FILMS OR SHEETS FOR CHELATE COLOR PRINTING

CROSS-REFERENCE TO RELATED APPLICATION

This is a division, of application Ser. No. 413,509, filed Nov. 7, 1973, abandoned.

BACKGROUND OF THE INVENTION a. FIELD OF THE INVENTION

This invention relates to a thermoplastic resin firm or sheet for chelate color printing and to a process for producing such a film or sheet.

b. DESCRIPTION OF THE PRIOR ART

A method has previously been known which involves forming on the surface of natural pulp paper a chelate color-forming layer composed mainly of a metal compound capable of forming a chelate compound on reaction with an organic compound, and printing this paper using a color forming ink composed of an aqueous solution containing, as a main constituent, an organic compound capable of reacting with the above metal compound, whereby color printing is effected by the formation of a chelate compound. This method, however, has the defect that where natural pulp paper is used as a substrate, the color forming layer intrudes deep into the spaces amoung the individual fibers of the substrate, and because the color forming ink is an aqueous solution, the resulting printed image becomes blurred or vague. Attempts have been made to remove such a defect ascribable to the use of natural pulp paper as a substrate by using a thermoplastic resin film or sheet as a substrate. However, since the surface of the thermoplastic resin film or sheet is smooth and is devoid of the ability to absorb color-forming ink, the sticking and drying properties of the printed image are insufficient and good printing is not obtained.

SUMMARY OF THE INVENTION

A primary object of this invention is to provide a thermoplastic resin film or sheet for chelate color printing which can remove such a defect, and can permit high speed chelate color printing to provide printed images of good vividness with good stickiness and drying properties.

A secondary object of this invention is to provide a thermoplastic resin film or sheet for chelate color printing which has superior water resitance and therefore does not involve blurring or disappearance of the printed image on wetting with water.

A third object of this invention is to provide a thermoplastic resin film or sheet for chelate color printing suitable for use, for example, as tags or labels for designating raw foodstuffs, machines and tools, industrial materials, etc., tickets for traffic conveniences, theaters, etc., and sheets for designating "point of sales" which have recently gained wide acceptance for use in machines attached to a computer system.

Other objects of this invention, along with its advantages, will become apparent from the following description.

According to this invention, there is provided a thermoplastic resin film or sheet for chelate color printing, said film or sheet comprising (1) a thermoplastic film or sheet having a porous layer on at least one surface thereof, and (2) a chelate color printing layer formed on the porous surface of said film or sheet and comprising (a) an inorganic compound containing at least one metal atom selected from the group consisting of iron, vanadium, titanium, molybdenum and tungsten, or (b) at least one organic compound capable of forming a color as a result of forming of a chelate compound with said metal atom.

DESCRIPTION OF PREFERRED EMBODIMENTS

Suitable thermoplastic resin constituting the film or sheet used in this invention are, for example, olefin resins, styrene resins, polyvinyl resins, polyamide resins, acrylic resins, polyether resins, polyester resins, polycarbonate resins, polyester-amide resins, polyester-ether resins, vinylidene chloride resin, polytetramethylene-hexamethylene resin, and polynonamethylene urea resins. These resins may be used alone or in combination. The preferred resins are olefin resins, styrene resins, polyvinyl resins, polyamide resins, and polycarbonate resins. These resins may further contain incorporated therein additives such as a plasticizer, coloring agent, filler, heat stabilizer, light stabilizer, surface active agent, antistatic agent, or lubricant.

Fabrication of the thermoplastic resin into films or sheets can be performed by various means. For example, there is employed a method which comprises mixing and kneading a thermoplastic resin and other additives by, for example, a Bumbury's mixer, mixing roll or extrusion-kneader, and subjecting the molten material to calender rolls. Another example of the fabrication method involves feeding the material into an extruder with or without prior mixing in a Henschel mixer or supermixer, etc. to knead and melt it in the extruder, and extruding the molten material into a film or sheet form. All other methods capable of melting the thermoplastic resin composition and fabricating it into a film or sheet form can be used.

The suitable thickness of the film or sheet is generally about 0.05 to 3 mm.

The thermoplastic resin film or sheet has a porous structure on at least one of its surfaces. The porous structure can be obtained, for example, by contacting a liquid capable of dissolving or swelling the thermoplastic resin constituting the film or sheet with that surface of the film or sheet which is desired to be rendered porous, and then removing the liquid. Or a method can also be used which comprises contacting a liquid capable of dissolving or swelling the thermoplastic resin with the surface, and then contacting the surface with a liquid which is compatible with the first liquid and does not dissolve or swell the thermoplastic resin thereby to coagulate the dissolved or swollen layer on the surface. Other various methods used in the art of making paper-like sheets can also be utilized for providing a porous surface on the film or sheet used in this invention.

It has been found that an especially suitable thermoplastic resin film or sheet can be prepared by forming a film or sheet from a mixture consisting of 100 parts of the thermoplastic resin, 1 to 100 parts of a rubbery thermoplastic polymeric substance and 1 to 500 parts of an inorganic substance in the finely divided state, and stretching the resulting film or sheet to at least 1.5 times the original length in at least one direction, thereby to form a porous, multilayered structure on at least one surface of the film or sheet.

Examples of the rubbery polymeric substance used for this purpose are natural rubber, polyisoprene rubber, polybutadiene rubber, polypropylene oxide, polychloroprene rubber, polyisobutylene, a rubber isobutylene/isoprene copolymer, a rubbery styrene/-butadiene copolymer, acrylic rubbers such as a rubbery acrylonitrile/butadiene copolymer, rubbery chlorosulfonated polyethylene, or a homopolymer or copolymer of an acrylic acid ester, silicone rubber, urethane rubber, polysulfide rubber, fluorine rubber, chloropolyethylene chlorinated rubbers, hydrochloric acid rubber, an ethylene/vinyl acetate copolymer rubber, or rubbery chlorinated polyethylene. These substances are used either along or in combination. The rubbery thermoplastic polymeric substance is added in an amount of 1 to 100 parts by weight, most preferably 5 to 50 parts by weight per 100 parts by weight of the thermoplastic resin.

Examples of the inorganic substance in the finely divided state include diatomaceous earth, kaolin, clay, talc, powdery silica, zeolite, mica powder, asbestos powder, alumina, calcium carbonate, magnesium carbonate, calcium sulfate, barium sulfate, zinc sulfide, lithopone, titanium oxide, and zinc oxide. They may be used either alone or in admixture. The particle size of the inorganic substance is not critical, but generally, those having a particle size of not more than 20 microns, preferably not more than 10 microns, are suitable. The amount of the powdery inorganic substance is 1 to 500 parts by weight per 100 parts by weight of the thermoplastic resin. It has been found that the best result is obtained when it is used in an amount of 5 to 300 parts by weight on the same basis.

The thermoplastic resin film or sheet so formed is then stretched to form a porous structure. The stretching temperature to be used is one sufficient for inducing effective molecular orientation and facilitating the formation of a porous structure, and is lower than the melting point of the thermoplastic resin which constitutes the film or sheet. The stretching may be performed in one direction, or in at least two directions simultaneously or consecutively.

Most commonly, the film or sheet is stretched in the longitudinal direction and in the transverse direction, preferably using a tenter type stretcher.

The preferred stretch ratio is at least 1.5 in one direction, most preferably at least 2 times, although it varies depending upon the desired porosity of the porous structure to be formed. Stretching at excessively high ratios should be avoided, and usually, the maximum stretch ratio is 15.

Thus, by the synergistic action of the individual constituents, a porous structure is formed not only on the surface layers of the film or sheet, but also in its interior. In addition, the porous structure formed is a porous multilayered structure consisting of many thin porous layers. Such a film or sheet having the porous multi-layered structure not only excels in whiteness and transparency as required of paper but also possesses superior mechanical strength characteristics such as tensile strength, tear strength or fold strength. Accordingly, such a film or sheet has been found especially advantageous for preparing the thermoplastic resin film or sheet for chelate color printing in accordance with this invention.

According to the invention, a chelate color printing layer is formed on that surface of the thermoplastic resin film or sheet which has a porous structure. The chelate-forming layer comprises (a) an inorganic compound of at least one metal atom selected from the group consisting of iron, vanadium, titanium, molybdenum and tungsten.

The iron atom in the above inorganic compound usually forms a chelate compound by reaction with an organic compound to form a color when it is trivalent; the vanadium atom does when it is tetravalent or pentavalent; the titanium atom does when it is tetravalent; and the molybdenum and tungsten atoms do when they are hexavalent. Accordingly, it is preferred to use the iron atom as a compound in which iron is present in the trivalent state, the vanadium atom as compounds in which this atom is present in tetravalent or pentavalent state; titanium atom as compounds in which this atom is present in the tetravalent state; and the molybdenum and tungsten atoms as compound in which these atoms are present in the hexavalent state.

Typical examples of suitable inorganic compounds are ferric chloride, sodium vanadate, vanadyl sulfate, vanadium oxychloride, titanium tetrachloride, sodium molybdate, and sodium tungstate.

The layer for chelate color printing may also contain an organic compound capable of reacting with at least one inorganic compound containing at least one metal atom selected from the group consisting of iron, vanadium, titanium, molybdenum and tungsten to form a chelate compound and thus to form a color. The most suitable organic compound used for this purpose is one which reacts with trivalent iron atom, tetravalent or pentavalent vanadium atom, tetravalent titanium atom, hexavalent molybdenum atom, and hexavalent tungsten atom, to form a color.

Examples of the organic compound include dihydroxybenzene, isopropyl catechol, diisopropyl catechol, tertiary butyl catechol, tertiary butyl-methyl catechol, tertiary octyl catechol, tertiary octyl-methyl catechol, $\alpha$-chloro-3,4-dihydroxyacetophenone, trihydroxyacetophenone, gallic acid, methyl gallic acid, gallic acid esters, dihydroxynaphthalene, dihydroxynaphthalenesulfonic acid salts, and dihydroxyphenylacetic acid. It should be noted however that the present invention is not limited to these organic compounds, but a wider range of organic compounds may be used for this purpose.

When a layer for chelate color printing which contains the above-mentioned inorganic compound is provided on the porous layer of the thermoplastic resin film or sheet, it is preferred that the inorganic compound be present on the porous layer at a rate of $0.2 \times 10^{-4}$ to $0.1 \times 10^{-1}$ mol/m$^2$.

Where a layer for chelate color printing which contains the above-mentioned organic compound is provided on the porous layer of the thermoplastic resin film or sheet, it is preferred that the organic compound be present on the proous surface at a rate of $0.3 \times 10^{-4}$ to $0.2 \times 10^{-1}$ mol/m$_2$.

If the above inorganic or organic compound for forming the chelate color printing layer is soluble in an organic solvent or water, the chelate color printing layer is suitably formed by bringing the porous structure of the thermoplastic resin film or sheet into contact with a solution of the compound in an organic solvent or water by coating, dipping, or spraying. Alternatively, a uniform dispersion of the compound in a liquid carrier is brought into contact with the porous structure of the thermoplastic resin sheet. No significant trouble occurs even if the above organic solvent has the ability to dissolve or swell the thermoplastic resin that constitutes the film or sheet.

In order to improve the absorption of color ink in the layer for chelate color printing, the stickiness and drying property of the printed image and the adhesion of the chelate color printing layer, it is possible, and preferable, to form such a layer from the above inorganic or organic compound, a fine powdery substance insoluble in water or an organic solvent, and a binder.

The fine powdery substance that can be used may, for example, be the powder of an inorganic substance such as calcium carbonate, magnesium carbonate, diatomaceous earth, kaolin, clay, talc, silica, zeolite, titanium oxide, barium sulfate, mica powder, alumina, or zinc oxide, the powder of an organic substance such as wood powder, microcrystalline cellulose powder, cork powder, ebonite powder, lignin or pulp powder, and an inorganic or organic fibrous material such as glass fibers, slag wool, cellulose fibers, or synthetic fibers cut short to a powdery state. These substances are used either alone or in combination.

Where the inorganic or organic powdery substance is used, the particle size is suitably not more than 20 micros, most preferably not more than 10 microns.

Where the inorganic or organic fibrous material cut short to a powdery state is used, the particle size is suitably not larger than 150 mesh (Tyler's sieve), and most preferably not larger than 200 mesh (Tyler's sieve).

Examples of the binder are synthetic resins such as polyvinyl alcohol, polyvinyl acetate, a vinyl acetate/acrylic ester copolymer, an ethylene/vinyl acetate copolymer, polyvinyl chloride, a polyacrylate resin, a polyester resin, a styrene/maleic acid copolymer, or a cellulose resin, various rubbery polymers such as a styrene/butadiene copolymer rubber, starch, casein, and gelatin. These substances may be used either alone or in combination.

The binder used for the chelate color printing layer serves to bind the inorganic or organic compound and the fine powdery substance to each other, and firmly adhere the chelate color printing layer to the surface of the film or sheet of thermoplastic resin.

The amounts of the finely divided substance and the binder can be varied over a wide range depending upon, for example, the type of the inorganic or organic compound. Generally, it is preferred that the amount of the inorganic or organic compound be 1 to 1000 parts by weight per 100 parts by weight of the finely divided substance and the binder combined. The volume ratio of the finely divided substance to the binder is suitable 90:10 to 30:70, most preferably 80:20 to 40:60.

Where the binder is soluble in an organic solvent or water dispersible in or swellable with it, it is preferable to dissolve or disperse it in, or swell it with, an organic solvent or water, then add the above inorganic or organic compound and the fine powdery substance, and uniformly mixing them. Where the binder is liquid, it is preferred to directly mix the inorganic or organic compound and the fine powdery substance uniformly with it. Furthermore, a coloring agent, surfactant, antistatic agent or stabilizer or various kinds may be added to the resulting mixture. The liquid so prepared is coated on the porous surface of the film or sheet by a customary method.

Prior to rendering at least one of the surfaces of the thermoplastic resin film or sheet porous, a ground pattern or ground printing may be applied to one or both surfaces of the film or sheet. Or such a ground pattern or ground printing may be applied to the layer for chelate color printing. The ground pattern or ground printing can be applied by a conventional printing method such as offset printing, relief printing, silk screen printing, or gravure printing. The gravure printing method is most generally used. When a ground pattern or ground printing is applied to the film or sheet of thermoplastic resin in advance and the chelate color printing layer is formed on it, is is preferred to render the chelate color printing layer as thin as possible, or omit the use of the insoluble fine powdery substance, whereby the ground pattern or ground printing can be seen through the chelate color printing layer.

The thermoplastic resin film or sheet for chelate color printing in accordance with this invention to which a ground pattern or ground color printing has been applied is especially suitable as tickets for sale by automatic ticket selling machines, or display sheets for designating articles, such as tags or labels.

Needless to say, films or sheets free from such a ground pattern or a ground color printing can be used.

The most convenient method for producing a thermoplastic film or sheet containing a chelate color printing layer in accordance with this invention comprises contacting at least one surface of the film or sheet with a mixture of (i) a liquid having the ability to dissolve or swell the thermoplastic resin, (ii) a liquid which is compatible with the liquid (i) but has no ability to dissolve or swell the thermoplastic resin and which has an evaporation rate greater than the above liquid (i), and (iii) an inorganic or organic compound of the type described above by such means as coating or dipping, evaporating the liquids (i) and (ii) from the mixture to cause the inorganic or organic compound to adhere to the surface of the film or sheet. This method makes it possible to form a porous structure and a chelate color printing layer simultaneously in one step.

The liquid (i) having the ability to dissolve or swell the thermoplastic resin is one which dissolves or swells the surface layer of the thermoplastic film or sheet upon contact. Although depending upon the thermoplastic resin, suitable examples of the liquid (i) are liquids containing xylene, monochlorobenzene, trichlorobenzene, cyclohexanone, dimethyl formamide or n-butyl acetate. These are used either alone or in combination according to the type of the thermoplastic resin and the treating conditions.

The liquid (ii) having no ability to dissolve and swell the thermoplastic resin in one which does not dissolve nor swell the thermoplastic resin film or sheet upon contact. This liquid is compatible with the liquid (i), and has a greater rate of evaporation than the liquid (i). Suitable examples of the liquid (ii) are liquids containing methyl alcohol, ethyl alcohol, isopropyl alcohol, tertiary butyl alcohol, ethyl ether, isopropyl ether, ethylene oxide, 1,2-propylene oxide, or dioxolan. These may be used either alone or in combination according to the liquid (i) and the operating conditions.

The preferred ratio between the liquid (i) having the ability to dissolve or swell the thermoplastic resin and the liquid (ii) having no ability to dissolve or swell it is such that the liquid (i) is used in an amount of 1 to 100 parts by weight, especially 5 to 50 parts by weight, per 100 parts by weight of the liquid (ii). If the proportion of the liquid (i) increases too much, it becomes impossible to control the dissolution or swelling of the surface layer of the thermoplastic resin film or sheet.

In order to increase the adhesion of the above inorganic or organic compound to the surface of the thermoplastic resin film or sheet thereby improving the stickiness and drying property of the printed image and enabling chelate color printing at high speed, it is preferred that an insoluble fine powdery substance is further mixed with the mixture of the inorganic or organic compound, the liquid (i) and the liquid (ii).

The insoluble fine powdery substance is insoluble both in the liquid (i) having the ability to dissolve and swell the thermoplastic resin and the liquid (ii) having no ability to dissolve and swell it. Examples of such an insoluble substance are fine particles of an inorganic substance such as calcium carbonate, magnesium carbonate, calcined gypsum, talc, barium sulfate, silica, alumina, glass powder, kaolin clay, white carbon, carbon black, titanium oxide, zinc sulfide, or mica powder, fine powders of an organic substance such as wood powder, microcrystalline cellulose powder, cork powder, ebonite powder, lignin, pulp powder, or powder of insoluble cellulose derivatives, and fibrous materials such as asbestos fibers, glass fibers, slag wool, cellulose fibers, and synthetic fibers. These compounds are used either alone or in combination.

Where the insoluble fine powdery substance (iv) is a particulate organic or inorganic substance, it preferably has a particle diameter of not more than 20 microns, more preferably not more than 10 microns. Where it is a fibrous substance, the preferred particle diameter is 150 mesh (Tyler's sieve) or smaller, most preferably, not greater than 200 mesh (Tyler's sieve). The preferred amount of the insoluble fine powdery substance (iv) is 0.1 to 50 parts by weight, most preferably 1 to 20 parts by weight, per 100 parts by weight of the liquid (ii) having no ability to dissolve or swell the thermoplastic resin.

In order to increase the dispersion stability of the fine powdery substance in the mixture of the liquids (i) and (ii), adjust the particle size, and increase uniform coatability, a small amount of a cellulose derivative soluble in the liquids (i) and (ii) such as nitrocellulose, methyl cellulose, ethyl cellulose, hydroxyethyl cellulose, carboxymethyl cellulose, ethylhydroxyethyl cellulose, or carboxymethylhydroxyethyl cellulose may be added.

The fine powdery substance (iv) may, for example, be in the form of colloidal sol, such as alumina sol or silica sol.

The mixture may also contain an additive such as a color agent, surfactant, antistatic agent or stabilizer of various kinds.

Contacting of the thermoplastic resin film or sheet with the above-described coating mixture comprising the liquids (i) and (ii), and the organic or inorganic compound (iii), or the insoluble fine powdery substance (iv), or further the cellulose derivative (v) soluble in the liquids (i) and (ii) is accomplished by dipping the film or sheet in the mixture, or coating or spraying the mixture on the surface of the film or sheet of the thermoplastic resin.

In the next place, the film or sheet is dried. Drying is most preferably carried out by heating the film or sheet, but spontaneous drying may be employed when the liquid having the ability to dissolve or swell the thermoplastic resin has a relatively fast rate of evaporation and is not likely to damage the film or sheet.

Since the mixture contains the liquid (i) having the ability to dissolve or swell the thermoplastic resin that constitutes the film or sheet and the liquid (ii) having no such ability, the liquid (i) evaporates at a slower rate than the liquid (ii). By the difference in the rate of evaporation, the concentration of the liquid (i) having the ability to dissolve or swell the thermoplastic resin increases, and consequently, the dissolution or swelling of the surface layer of the film or sheet become rapidly predominant. Finally, the dissolved or swollen thermoplastic resin coagulates and a porous structure composed of very fine pores is formed on the surface of the thermoplastic film or sheet. Thus, the coagulated thermoplastic resin acts as a binder to cause the inorganic or organic compound to adhere firmly in a state of having penetrated into the interior of the pores.

Where the above coating mixture contains the fine powdery substance (iv) insoluble in any of the liquids (i) and (ii), this substance is adhered to the surface of the film or sheet together with the dissolved or swollen thermoplastic resin, and the inorganic or organic compound (iii) is firmly adhered to it in the state of having penetrated into the interior of the pores.

When the fine powdery substance (iv) is adhered to the surface of the thermoplastic resin film or sheet, the adhesion of the inorganic or organic substance (iii) to the surface of the film or sheet become firmer. The adhesion of the fine powdery substance (iv) to the surface of the film or film contributes to an improvement in the absorption of color ink by the film or sheet, the stickiness of the printed image and the drying property of the printed image.

Where the cellulose derivative (iv) is mixed, it acts as a binder same as the coagulated thermoplastic resin, and enables the insoluble fine powdery substance to adhere firmly to the surface of the film or sheet.

When the chelate color printing layer is formed by an inorganic compound containing at least one metal atom selected from iron, vanadium, titanium, molybdenum and tungsten, an organic compound capable of forming a chelate compound with the metal atom in the inorganic compound to develop a color is used as a color forming ink. On the other hand, when it is formed of an organic compound capable of forming a chelate compound with at least one metal atom selected from the group consisting of iron, vanadium, titanium, molybdenum and tungsten to develop a color, an inorganic compound having the above metal atom is used as a color forming ink.

When the inorganic compound contains an iron atom, it is preferably used as one containing trivalent iron; when it contains a vanadium atom, it is preferably used as one containing tetravalent or pentavalent and when it contains a titanium atom, it is preferably used as one containing tetravalent or pentavalent vanadium, or tetravalent titanium; and when it contains a molybdenum or tungsten atom, it is preferably used as one containing a hexavalent molybdenum or tungsten atom.

Such an organic or inorganic compound is used in the form of a solution or dispersion in the color forming ink. When the organic compound is used as a color forming ink, it is preferred that it be present in the ink in a concentration of $0.4 \times 10^{-2}$ to 20 mol/liter. When the inorganic compoundis sused as a coloring ink, it is preferably present in the ink in a concentration of $0.1 \times 10^{-3}$ to 0.5 mol/liter.

The printed image formed on the film or sheet of this invention by chelate color printing mainly has a color of black, black blue or sepia, which color is most suitable as the color of printed images.

The printed images appear instantaneously, and dry quickly. Moreover, the images are very clear and vivid. Since the images are insoluble in water, they are not blurred or do not disappear, even when they are wetted with water.

The film or sheet of this invention is suitable for use as tags or labels for designating raw foodstuffs, machines and tools, and industrial materials, designating labels with one surface having a layer of an adhesive and the other surface laving a layer for chelate color printing, tickets for railway cars, boats and airplanes, coupon cards, or credit cards, display sheets for designating the point of sales, and other display sheets.

The following Examples illustrate the present invention. All parts in the Examples are parts by weight.

EXAMPLE 1

A 0.3 mm thick polystyrene sheet was dipped in dimethyl formamide at room temperature for 0.6 second, and immediately then dipped in a large quantity of water. The surface of the sheet obtained had a porous structure composed of micropores and was non-transparent. Methyl ethyl ketone containing 20% by weight of lauryl gallate was coated on one surface of the polystyrene sheet at a rate of 20 g/m$^2$, and the sheet was dried by heating at 70° C. for 2 minutes. There was obtained a polystyrene sheet for chelate color printing having formed on its surface a layer for chelate color printing which was transparent and consisted of lauryl gallate.

Printing was made on that surface of the polystyrene sheet which had the chelate color printing layer using as a color forming ink an aqueous solution of 0.05 mol of vanadyl sulfate in 1 liter of water. Instantaneously, a black chelate color printing image was obtained. The image was vivid and insoluble in water.

EXAMPLE 2

Polyethylene resin: 100 parts
Styrene/acrylonitrile copolymer: 50
Rubbery ethylene/vinyl acetate copolymer: 20
Diatomaceous earth: 30
Titanium oxide: 5

A composition of the above formulation was kneaded by rolls for 15 minutes at 160° C., and formed into a 0.6 mm thick sheet using an inverted L-shaped calender roll heated at 180° C. Then, the sheet was stretched successively in the longitudinal and transverse directions at a stretch ratio of 3.0 in each direction while being maintained at 110° C. The resulting film had a porous multilayered structure composed of a number of micropores, and was white and translucent. It had a specific gravity of 0.80.

A methyl alcohol solution containing 10% by weight of lauryl gallate was coated on one surface of the resulting film in an amount of 20 g/m$^2$, and dried by heating at 70° C. for 30 seconds to form a layer composed of lauryl gallate for chelate color printing.

An aqueous solution of 0.05 mol of sodium metavanadate in 1 liter of water was prepared. Using this solution as a color forming ink, chelate color printing was made on the sheet. Instantaneously, the printed surface developed a clear black color. The printed image dried well, and when the printed surface was rubbed with gauze immediately after printing, no blurring was caused on the printed image.

EXAMPLE 3

A 1.0 mm thick sheet was formed under the same conditions as in Example 2. While being maintained at 110° C., the sheet was stretched simultaneously in the longitudinal and transverse directions at a stretch ratio of 2.0 in each direction. The resulting sheet was white and translucent and had superior physical properties such as tear strength, tensile strength and fold strength.

Microscopic examination of the sheet showed that it had a porous multilayered structure. An ethanol solution containing 20% by weight of ferric chloride was coated on one surface of the sheet in an amount of 20 g/m$^2$, and while being heated at 70° C., it was dried for 2 minutes to form a layer for chelate color printing.

Necessary items are printed on the surface of the sheet using a color printing ink consisting of a solution composed of 0.05 mol of propyl gallate, 30 parts of water, 20 parts of diethylene glycol and 50 parts of ethanol. The printed sheet was used as a tag. The printed image was black blue, and vivid and clear. The drying of the chelate color ink was rapid.

EXAMPLE 4

A solution consisting of 100 parts of isopropyl alcohol, 10 parts of polyvinyl acetate and 1.5 parts of tertiary butyl catechol was uniformyl mixed with 20 parts of kaolin, 5 parts of finely divided silica and 30 parts of toluene. The mixture was coated on the surface of a polystyrene sheet obtained in the same way as in Example 1, in an amount of 80 g/m$^2$. The coated sheet was dried by heating at 70° C. for 2 minutes. There was obtained a polystyrene sheet having a chelate color printing layer composed of polyvinyl acetate, tertiary butyl catechol, kaolin and finely divided silica.

When a cellophane tape was adhered to the surface of the chelate color printing layer, and peeled off at high speed, no removal of this layer occurred. Furthermore, when this layer was strongly rubbed with gauze, it was not stripped off.

Chelate color printing was made on this sheet using a color forming ink consisting of an aqueous solution of 0.05 mol of sodium vanadate in 1 liter of water at high speed using a printing press. The printed surface instantaneously developed a vivid black color. Even when the printed surface was strongly rubbed immediately after printing, the blurring of the printed image did not occur. The printed image had superior stickiness and drying property, and had a high degree of vividness.

EXAMPLE 5

Aluminum oxide (40 parts), 10 parts of titanium oxide and 1 part of sodium molybdate were uniformly mixed with a solution consisting of 50 parts of ethyl acetate, 30 parts of toluene, 20 parts of methyl ethyl ketone and 15 parts of an ethylene/vinyl acetate copolymer (containing 40% of vinyl acetate). The resulting mixture was coated on both surface of the same sheet as obtained in Example 2, in an amount of 80 g/m$^2$. While being heated at 80° C., the sheet was dried for 1.5 minutes.

There was formed on the surfaces of the sheet a chelate color printing layer consisting of the ethylene/vinyl acetate copolymer, aluminum oxide, titanium oxide, and sodium molybdate. When a cellophane tape was adhered to these layers and peeled off at high speed, no strip off of the layers occurred.

Using a color forming ink consisting of an aqueous dispersion of 0.05 mol of propyl gallate in 1 liter of water, chelate color printing was made on these layers at high speed by a printing press. The printed surfaces instantaneously developed a vivid sepia color. When the printed surface was strongly rubbed immediately after printing, no blurring of the printed image occurred. The printed image had superior stickiness and drying properties, and was clear and vivid.

EXAMPLE 6

A 0.2 mm thick biaxially stretched polycarbonate sheet was coated on its one surface with a mixture consisting of 100 parts of methanol, 20 parts of 3-isopropyl catechol, 3 parts of nylon staple fibers (1.5 denier, passing 150-mesh), and 10 parts of methyl ethyl ketone solution containing 20% by weight of 1,2-dihydroxynaphthalene, and dried at 70° C. A porous layer was thus formed on one surface of the polycarbonate sheet and 3-isopropyl catechol and the nylon staple fibers adhered to that surface.

A light blue round pattern was printed on the resulting chelate color printing layer by gravure printing. The sheet was then mounted on an automatic ticket selling machine, and necessary items were printed on it by a printing device in the machine using a chelate color forming ink consisting of an aqueous solution of 0.05 mol of sodium tungstate in 1 liter of water, followed by cutting into a ticket by a cutter in the machine. The printed image was of a sepia color, and vivid and clear.

EXAMPLE 7

The surface of a biaxially stretched polyvinyl chloride sheet having a thickness of 0.2 mm was coated with a mixture consisting of 100 parts of ethyl alcohol, 50 parts of cyclohexanone, 1 part of ethyl cellulose, 30 parts of mthanol silica sol and 10 parts of an ethanol solution containing 20% by weight of titanium chloride in an amount of 20 g/m$^2$. While being heated at 70° C., the sheet was dried in the course of 2 minutes. Thus, a chelate color printing porous layer containing silica particles, titanium tetrachloride and ethyl cellulose was formed on the surface of the sheet.

A light blue ground pattern was printed by gravure printing on the surface of the chelate color printing layer.

The sheet was then mounted on an automatic ticket selling machine, and printed by a printing device in the machine using a color forming ink consisting of a solution composed of 0.05 mol of 1,2-dihydroxynaphthalene, 30 parts of water, 20 parts of diethylene glycol and 50 parts of ethanol. The printed area was cut by a cutter in the machine as a ticket.

The printed image was sepia-colored, and clear and vivid.

EXAMPLE 8

A ground pattern was printed on one surface of a 0.15 mm polystyrene resin sheet having a porous structure obtained in the same manner as in Example 1, using a gravure printing ink. Methyl ethyl ketone containing 20% of dihydroxybenzene was then coated on the printed surface in an amount of 20 g/m$^2$, and dried at 70° C. in the course of 2 microns. Thus, a chelate color printing layer consisting of the dihydroxybenzene was formed on that surface of the sheet on which a ground pattern had been printed.

The sheet was then mounted on an automatic ticket selling machine, and necessary items were printed on the sheet using a printing device in the machine, followed by cutting into a ticket by a cutter in the machine.

The printed image was black and clear, and the ground pattern printed could be seen through the chelate color printing layer. The chelate color printing ink dried in 3 seconds after printing, and after then, the printed imaged did not blur nor was disfigured even by strong rubbing.

EXAMPLE 9

A mixture consisting of 100 parts of methyl alcohol, 80 parts of cyclohexanone and 10 parts of a methyl ethyl ketone solution containing 20% by weight of lauryl gallate was coated on the surface of a 0.1 mm thick polyvinyl chloride film in an amount of 20 g/m$^2$. While being heated at 70° C., it was dried in the course of 2 minutes.

A microporous and compact layer was formed on the coated surface of the vinyl chloride resin film, and it was confirmed that lauryl gallate adhered to the surface.

Using a color forming ink consisting of an aqueous solution of 0.05 mol of sodium metavanadate in 1 liter of water, chelate color printing was performed on the sheet on a printing press.

The printed surface instantaneously developed a clear black color. When the printed surface was rubbed with gauze immediately after printing, no blurring of the printed surface occurred.

EXAMPLE 10

The surface of a 0.1 mm thick polystyrene film was coated with a mixture consisting of 100 parts of methyl alcohol, 10 parts of cyclohexanone, 1 part of ethyl cellulose and 10 parts of a methyl ethyl ketone solution containing 20% by weight of 3-isopropyl catechol in an amount of 20 g/m$^2$, followed by drying at 90° C. for 2 minutes.

3-Isopropyl catechol adhered to the surface of the resulting polystyrene film. When a cellophane tape was bonded to the surface of the film and peeled off at high speed or the surface of the film was rubbed strongly with gauze, the surface layer was not stripped off from the film.

Using a color forming ink consisting of an aqueous solution of 0.05 mol of sodium tungstate in 1 liter of water, the polystyrene film was printed on a printing press. The printed surface instantaneously developed a clear sepia color. When the printed surface was strongly rubbed with gauze immediately after printing, no blurring of the printed image occurred.

EXAMPLE 11

The surface of a 0.1 mm thick polyvinyl film was coated with a mixture consisting of 30 parts of isopropyl alcohol, 70 parts of toluene, 30 parts of methyl ethyl ketone, 15 parts of fine powder of silica, 10 parts of a methyl ethyl ketone, and 2 parts of sodium tungstate in an amount of 20 g/m$^2$, followed by drying for 2 minutes at 70° C.

A porous layer containing fine powder of silica and sodium tungstate was thus formed on the surface of the film. When a cellophane tape was bonded to the surface layer of the film and peeled off at high speed, the surface layer was not stripped off.

Using a color forming ink consisting of an aqueous dispersion of 0.05 mol of 3-isopropyl catechol in 1 liter of water, the polyvinyl chloride film was subjected to chelate color printing at high speed on a printing press. The printed surface instantaneously developed a clear sepia color, and the printed image had superior stickiness and drying property. The vividness of clearness of the printed image was also found excellent.

EXAMPLE 12

The surface of a polycarbonate film having a thickness of 0.1 mm was coated with a mixture consisting of 100 parts of methyl alcohol, 20 parts of dimethyl formamide, 3 parts of nylon staple fibers (1.5 denier, passing 150 mesh) and 10 parts of a methyl ethyl ketone solution containing 20% of 1,2-dihydroxynaphthalene in an amount of 20 g/m$^2$, followed by dring at 70° C. for 2 minutes.

A porous layer containing the nylon staple fibers and 1,2-hydroxynaphthalene was thus formed on the surface of the film. When a cellophane tape was bonded to the surface of the film and peeled off at high speed or the surface was strongly rubbed with gauze, the surface layer was not stripped off.

Using a color forming ink consisting of an aqueous solution of 0.05 mol of titanium tetrachloride in 1 liter of water, the polycarbonate film was printed on a printing press. The printed surface instantaneously developed a vivid sepia color, and the printed image had superior stickiness and drying property. The degree of vividness or clearness of the printing image was also found to be excellent.

What is claimed is:

1. A process for producing a thermoplastic resin film for chelate color printing, which comprises A. contacting at least one surface of a thermoplastic resin film with a mixed liquid composition comprising:

i. a liquid capable of dissolving or swelling said thermoplastic resin, ii. a liquid having no ability to dissolve or swell said thermoplastic resin, compatible with said liquid (i) and having a faster rate of evaporation than said liquid (i), said liquid (i) being used in an amount of 1 to 100 parts by weight per 100 parts by weight of the liquid (ii), and (iii)

a. an inorganic compound containing at least one metal atom selected from the group consisting of iron in the trivalent state, vanadium in the tetravalent or pentavalent state, molybdenum in the hexavalent state, titanium in the tetravalent state, and tungsten in the hexavalent state, or b. an organic compound capable of forming a chelate compound with the metal atom and developing a color, and B. evaporating off said liquids (i) and (ii), thereby to form a porous layer of said film on the said contacted surface of the film and to simultaneously form on the porous surface of said layer a chelate color printing layer comprising said inorganic or organic compound (iii), said inorganic compound being present in the said mixed liquid in such amounts that it is deposited on the porous surface of the thermoplastic resin film in amounts of $0.2 \times 10^{-4}$ to $0.1 \times 10^{-1}$ mol/m$^2$ and wherein the organic compound is present in the liquid mixture in such amounts that it is deposited on the thermoplastic resin film in amounts of $0.3 \times 10^{-4}$ to $0.2 \times 10^{-1}$ mol/m$^2$.

2. The process of claim 1 wherein said mixed liquid comprises said liquids (i) and (ii), said organic or inorganic compound (iii), and a finely divided substance (iv), insoluble in both the said liquids (i) and (ii), said substance serving to increase the adhesion of said compound (iii) to the said porous surface.

3. A process according to claim 1 wherein the liquid (i) is at least one member selected from the group consisting of xylene, monochlorobenzene, trichlorobenzene, cyclohexanone, dimethyl formamide and n-butyl acetate; the liquid (ii) is at least one member selected from the group consisting of methyl alcohol, ethyl alcohol, isopropyl alcohol, tertiary butyl alcohol, ethyl ether, isopropyl ether, ethylene oxide, 1,2-propylene oxide, or dioxolan; the inorganic compound (iii) (a) is selected from the group consisting of ferric chloride, sodium vanadate, vanadyl sulfate, vanadium oxychloride, titanium tetrachloride, sodium molybdate, and sodium tungstate, and the organic compound (iii) (b) capable of forming a chelate compound with the metal atom is selected from the group consisting of dihydroxybenzene, isopropyl catechol, diisopropyl catechol, tertiary butyl catechol, tertiary butyl-methyl catechol, tertiary octyl catechol, tertiary octyl-methyl catechol, α-chloro-3,4-dihydroxyacetophenone, trihydroxyacetophenone, gallic acid, methyl gallic acid, gallic acid esters, dihydroxynaphthalene, dihydroxynaphthalenesulfonic acid salts and dihydroxyphenylacetic acid.

4. A process according to claim 3 wherein component (iii) is an inorganic compound.

5. A process accordng to claim 3 wherein component (iii) is an organic compound.

6. A process according to claim 3 wherein the liquid (i) is one having the ability to dissolve the thermoplastic resin.

7. A process according to claim 3 wherein the liquid (i) is one having the ability to swell the thermoplastic resin.

8. A process according to claim 1, wherein component (iii) is an inorganic compound containing vanadium.

9. A process according to claim 1, wherein component (iii) is an inorganic compound containing titanium.

10. A process according to claim 1, wherein component (iii) is an inorganic compound containing molybdenum.

11. A process according to claim 1, wherein component (iii) is an inorganic compound containing tungsten.

12. A process for producing a thermoplastic resin film for chelate color printing which comprises A. contacting at least one surface of a thermoplastic resin film with a mixed liquid composition comprising:

i. a liquid capable of dissolving or swelling said thermoplastic resin, which liquid is at least one member selected from the group consisting of xylene, monochlorobenzene, trichlorobenzene, cyclohexanone, dimethyl formamide and n-butyl acetate, ii. a liquid having no ability to dissolve or swell said thermoplastic resin and being compatible with said liquid (i) and having a faster rate of evaporation than said liquid (i), which liquid is at least one member selected from the group consisting of methyl alcohol, ethyl alcohol, isopropyl alcohol, tertiary butyl alcohol, ethyl ether, isopropyl ether, ethylene oxide, 1,2-propylene oxide, and dioxolan, said liquid (i) being used in an amount of 1 to 100 parts by weight, per 100 parts by weight of the liquid (ii), iii. a. an inorganic compound selected from the group consisting of ferric chloride, sodium vanadate, vanadyl sulfate, vanadium oxychloride, titanium tetrachloride, sodium molybdate, and sodium tungstate, or b. an organic compound capable of forming a chelate compound with the inorganic compound (a) and developing a color, said organic compound being selected from the group consisting of dihydroxybenzene, isopropyl catechol, diisopropyl catechol, tertiary butyl catechol, tertiary butyl-methyl catechol, tertiary octyl catechol, tertiary octyl-methyl catechol, α-chloro-3,4-dihydroxyacetophenone, trihydroxyacetophenone, gallic acid, methyl gallic acid, gallic acid esters, dihydroxynaphthalene, dihydroxynaphthalenesulfonic acid salts and dihydroxyphenylacetic acid, iv. 0.1 to 50 parts by weight, per 100 parts of the liquid (ii) of a finely divided substance, insoluble in both the said liquids (i) and (ii), said substance serving to increase the adhesion of said compound (iii) to the porous surface to be formed in subsequent step B), said substance being selected from the group consisting of calcium carbonte, magnesium carbonate, calcined gypsum, talc, barium sulfate, silica, alumina, glass powder, kaolin clay, white carbon, carbon black, titanium oxide, zinc sulfide, mica powder, wood powder, microcrystalline cellulose powder, cork powder, ebonite powder, lignin, pulp powder, asbestos fibers, glass fibers, slag wool, cellulose fibers and synthetic fibers, and v. an effective amount to increase the dispersion stability of the substance (iv) of a cellulose derivative soluble in liquids (i) and (ii), and selected from the group consisting of nitrocellulose, methyl cellulose, ethyl cellulose, hydroxyethyl cellulose, carboxymethyl cellulose, ethylhydroxyethyl cellulose, and carboxymethylhydroxyethyl cellulose, and B. evaporating off said liquids (i) and (ii), thereby to form a porous layer of said film on the said contacted surface of the film and to similtaneously form on the porous surface of said layer a chelate color printing layer comprising said inorganic or organic compound (iii), said inorganic compound being present in the said mixed liquid in such amounts that it is deposited on the porous surface of the thermoplastic resin film in amounts of $0.2 \times 10^{-4}$ to $0.1 \times 10^{-1}$ mol/m$^2$ and wherein the organic compound is present in the liquid mixture in such amounts that it is deposited on the thermoplastic resin film in amounts of $0.3 \times 10^{-4}$ to $0.2 \times 10^{-1}$ mol/m$^2$.

13. A process according to claim 12 wherein component (iii) is an inorganic compound.

14. A process according to claim 12 wherein component (iii) is an organic compound.

15. A process according to claim 12 wherein the liquid (i) is one capable of swelling the thermoplastic resin.

16. A process according to claim 13 wherein the liquid (i) is one capable of swelling the thermoplastic resin.

17. A process according to claim 14 wherein the liquid (i) is one capable of swelling the thermoplastic resin.

18. A process according to claim 12 wherein the liquid (i) is one capable of dissolving the thermoplastic resin.

19. A process according to claim 13 wherein the liquid (i) is one capable of dissolving the thermoplastic resin.

20. A process according to claim 14 wherein the liquid (i) is one capable of dissolving the thermoplastic resin.

* * * * *